US005816402A

United States Patent [19]

Weder et al.

[11] Patent Number: 5,816,402

[45] **Date of Patent: *Oct. 6, 1998**

[54] SHIPPING CARTON AND METHOD FOR SHIPPING FLORAL GROUPINGS

[75] Inventors: Donald E. Weder, Highland, Ill.; Sue Corbett, Edmond, Okla.

[73] Assignee: Southpac Trust International, Inc.

[ * ] Notice: The term of this patent shall not extend beyond the expiration date of Pat. No. 5,407,072.

[21] Appl. No.: 970,178

[22] Filed: Nov. 13, 1997

Related U.S. Application Data

[63] Continuation of Ser. No. 375,451, Jan. 19, 1995, Pat. No. 5,687,846, which is a continuation of Ser. No. 216,749, Mar. 23, 1994, Pat. No. 5,407,072, which is a continuation-in-part of Ser. No. 93,109, Jul. 16, 1993, Pat. No. 5,311,992, which is a continuation-in-part of Ser. No. 892,441, Jun. 2, 1992, Pat. No. 5,240,109, which is a continuation of Ser. No. 831,767, Feb. 5, 1992, Pat. No. 5,148,918, which is a continuation-in-part of Ser. No. 692,329, Apr. 26, 1991, Pat. No. 5,092,465.

[51] Int. Cl.[6] ..... B65D 85/52

[52] U.S. Cl. ..... 206/423; 206/460

[58] Field of Search ..... 206/423, 460, 206/495, 813

[56] References Cited

U.S. PATENT DOCUMENTS

| | | |
|---|---|---|
| 1,064,813 | 6/1913 | Bloomberg . |
| 2,165,539 | 7/1939 | Dahlgren . |
| 2,373,634 | 4/1945 | Wagner . |
| 2,578,583 | 12/1951 | O'Brien . |
| 2,664,670 | 1/1954 | Mulford . |
| 2,707,352 | 5/1955 | Fischer . |
| 2,721,022 | 10/1955 | Billerbeck . |
| 2,744,624 | 5/1956 | Hoogstoel et al. . |
| 2,871,080 | 1/1959 | Shelly . |
| 3,113,673 | 12/1963 | Stein . |

(List continued on next page.)

FOREIGN PATENT DOCUMENTS

| | | |
|---|---|---|
| 192843 | 11/1957 | Austria . |
| 686577 | 12/1995 | European Pat. Off. . |
| 2221936 | 10/1974 | France . |
| 8026641 | 12/1980 | France . |
| 2735225 | 4/1978 | Germany . |
| 61058 | 4/1989 | Japan . |
| 4352664 | 12/1992 | Japan . |
| 8101464 | 3/1981 | Netherlands . |
| 26878 | of 1913 | United Kingdom . |
| 432899 | 8/1935 | United Kingdom . |

OTHER PUBLICATIONS

Oasis Grower Products; Smithers–Oasis; Kent, OH; 1991.

*Primary Examiner*—Jacob K. Ackun
*Attorney, Agent, or Firm*—Dunlap & Codding, P.C.

[57] ABSTRACT

A shipping carton including a box assembly and a plurality of pots containing floral groupings. A bonding material is applied to the base of the box assembly and the pots containing floral groupings are disposed in the retaining space of the box so that the bonding material engages and connects each of the pots containing floral groupings. Retaining inserts may be disposed in the retaining space of the box to retain the growing medium contained in the pots within the pots during movement or shipment of the box assembly. The retaining inserts may be secured to the inner surface of the side walls of the box through a securing means such as a clip to prevent displacement of the retaining inserts during movement or shipment of the box assembly.

5 Claims, 7 Drawing Sheets

U.S. PATENT DOCUMENTS

| | | | |
|---|---|---|---|
| 3,322,323 | 5/1967 | Green et al. . | |
| 3,374,884 | 3/1968 | Chinkes . | |
| 3,389,784 | 6/1968 | Hendricks et al. . | |
| 3,466,214 | 9/1969 | Polk et al. . | |
| 3,488,022 | 1/1970 | Vittori . | |
| 3,524,583 | 8/1970 | Gregory . | |
| 3,708,946 | 1/1973 | Cahill . | |
| 3,734,280 | 5/1973 | Amneus et al. . | |
| 3,754,642 | 8/1973 | Stidolph . | |
| 3,883,990 | 5/1975 | Stidolph . | |
| 3,924,354 | 12/1975 | Gregoire . | |
| 4,053,049 | 10/1977 | Beauvais . | |
| 4,170,301 | 10/1979 | Jones et al. . | |
| 4,396,120 | 8/1983 | Morita . | |
| 4,470,508 | 9/1984 | Yen . | |
| 5,065,922 | 11/1991 | Harris . | |
| 5,092,465 | 3/1992 | Weder et al. . | |
| 5,111,638 | 5/1992 | Weder | 53/397 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |
| 5,311,992 | 5/1994 | Weder et al. | 206/423 |
| 5,407,072 | 4/1995 | Weder et al. | 206/423 |
| 5,411,137 | 5/1995 | Weder et al. | 206/423 |
| 5,522,205 | 6/1996 | Weder . | |
| 5,564,567 | 10/1996 | Weder | 206/423 |

SHIPPING CARTON AND METHOD FOR SHIPPING FLORAL GROUPINGS

CROSS-REFERENCE TO RELATED APPLICATIONS

This application is a continuation of Ser. No. 08/375,451, filed Jan. 19, 1995, issuing as U.S. Pat. No. 5,687,846 on Nov. 18, 1997, which is a continuation of U.S. Ser. No. 08/216,749, filed Mar. 23, 1994, entitled "SHIPPING CARTON AND METHOD FOR SHIPPING FLORAL GROUPINGS", now U.S. Pat. No. 5,407,072, issued Apr. 18, 1995; which is a continuation-in-part of U.S. Ser. No. 08/093,109, filed Jul. 16, 1993, entitled RETAINING FLAP FOR SHIPPING CARTONS; now U.S. Pat. No. 5,311,992, issued May 17, 1994 which is a continuation-in-part of U.S. Ser. No. 07/892,441, filed Jun. 2, 1992, entitled SHIPPING CARTON FOR FLORAL GROUPING ASSEMBLIES, now U.S. Pat. No. 5,240,109, issued Aug. 31, 1993 which is a continuation of U.S. Ser. No. 07/831,767, filed Feb. 5, 1992, entitled SHIPPING CARTON FOR FLORAL GROUPING ASSEMBLIES, now U.S. Pat. No. 5,148,918, issued Sep. 22, 1992 which is a continuation-in-part of U.S. Ser. No. 07/692,329, filed Apr. 26, 1991, entitled SHIPPING CARTON FOR FLORAL GROUPING ASSEMBLIES, now U.S. Pat. No. 5,092,465, issued Mar. 3, 1992.

FIELD OF THE INVENTION

The present invention generally relates to an improved shipping carton for flower pots and methods of using same.

DESCRIPTION OF THE PREFERRED EMBODIMENTS

Figure 1:
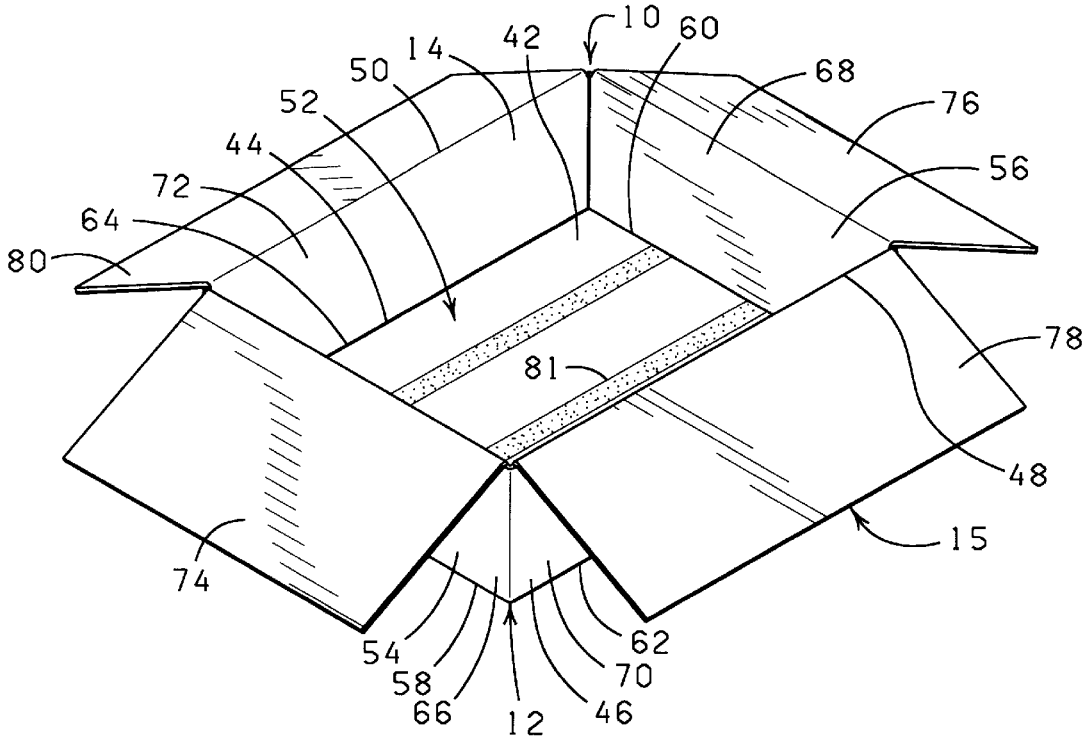
FIG. 1 a perspective view of a box assembly constructed in accordance with the present invention.
Figure 2:
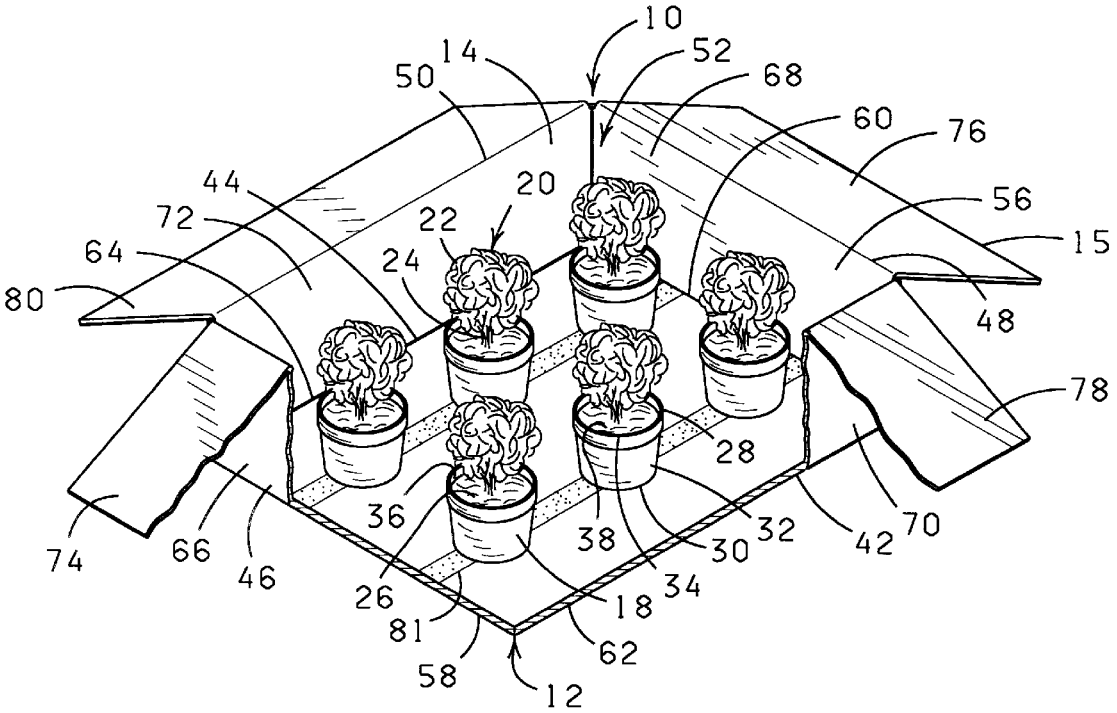
FIG. 2 is a perspective cutaway view of a box assembly showing a plurality of flower pots which contain floral grouping assemblies disposed in the box assembly.

The Embodiments and Method of FIGS. 1 and 2

Shown in FIGS. 1 and 2 is a shipping carton which is constructed in accordance with the present invention and designated by the general reference numeral 10. The shipping carton includes a box assembly 12. The box assembly 12 comprises a box 14 and box flaps generally designated as 15.

The box assembly 12 is particularly shaped and sized to accommodate a plurality of flower pots, only one of which is designated as 18 (FIG. 2). The term "flower pot" refers to any type of container used for holding a floral grouping or a potted plant. Examples of flower pots used in accordance with the present invention include, but are not limited to, clay pots, plastic pots, wood pots, and the like. "Floral grouping" as used herein means cut fresh flowers, artificial flowers, a single flower, other fresh and/or artificial plants or other floral materials, and may include other secondary plants and/or ornamentation or artificial or natural materials which add to the aesthetics of the overall floral grouping. The floral grouping 20 comprises a bloom or foliage portion 22, a stem portion 24 and a root portion 25 (shown in FIGS. 9, 14 and 17). However, it will be appreciated that the floral grouping 20 may consist of only foliage 22 or only a single bloom (not shown). Each flower pot 18 contains a floral grouping 20 partially disposed in a growing medium 26. The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The flower pots 18 may be further described as having an upper end 28, a lower base 30, an outer surface 32, an opening 34 intersecting the upper end 28 forming an inner surface 36 and a retaining space 38, wherein the growing medium 26 and the floral groupings 20 are disposed in the retaining space 38 of the flower pot 18.

The box 14 comprises a base 42 having an outer periphery 44.

A plurality of side walls 46 (only one of which is designated by the numeral 46) are connected to the base 42, and the plurality of side walls 46 extend about the outer periphery 44 of the base 42. Each of the plurality of side walls 46 extends a distance about perpendicularly from the base 42 with the plurality of side walls 46 each interconnecting and the interconnected plurality of sidewalls 46 each terminating with an upper end 48 forming an open upper end 50 of the box 14. The side walls 46 and the base 42 cooperate to partially enclose a retaining space 52.

The box 14 has an outer surface 54 and an inner surface 56. The outer and the inner surfaces 54 and 56 each are formed by portions of the base 42 and portions of the side walls 46.

The base 42 more particularly comprises a first end 58, a second end 60, a first side 62 and a second side 64. The base 42 generally is rectangularly shaped, although it will be appreciated that the base 42 may comprise any geometric or non-geometric shape. As shown in FIG. 1, the side walls 46 more particularly comprise a first end wall 66, a second end wall 68, a first side wall 70 and a second side wall 72. The first end wall 66 is connected to the base 42 and extends generally along the first end 58 of the base 42. The second end wall 68 is connected to the base 42 and extends generally along the second end 60 of the base 42. The first side wall 70 is connected to the base 42 and extends generally along the first side 62 of the base 42. The second side wall 72 is connected to the base 42 and extends generally along the second side 64 of the base 42. The first end wall 66, the second end wall 68, the first side wall 70 and the second side wall 72 are interconnected to form the continuous side wall 46 extending about the outer periphery 44 of the base 42.

As shown in FIG. 1, the box lid 82 comprises a first lid flap 74, a second lid flap 76, a third lid flap 78 and a fourth lid flap 80. The first lid flap 74 is connected to the upper end of the first end wall 66, the first lid flap 74 extending along the entire length of the first end wall 66 and extending a distance therefrom. The second lid flap 76 is connected to the upper end of the second end wall 68 and extends along the entire length of the upper end of the second end wall 68 and a distance therefrom. The third lid flap 78 is connected to the upper end of the first side wall 70 and extends along the entire length of the first side wall 70 and a distance therefrom. The fourth lid flap 80 is connected to the upper end of the second side wall 72 and extends along the entire length of the second side wall 72 and a distance therefrom. The lid flaps 74, 76, 78 and 80 are shown in FIG. 1 in the opened position wherein each of the lid flaps 74, 76, 78 and 80 are folded away from the opened upper end 50 of the box 14.

Each of the lid flaps 74, 76, 78 and 80 is movable to a position wherein each of the lid flaps 74, 76, 78 and 80 extends over a portion of the opened upper end 50 of the box 14 and generally over at least a portion of the retaining space 52. The lid flaps 74, 76, 78 and 80 cooperate with the box 14 to substantially enclose and encompass the retaining space 52 in the closed position of the lid flaps 74, 76, 78 and 80 (not shown).

The box assembly 12 includes a connecting bonding material 81 applied to the base 42 of the box assembly 12. The term "connecting bonding material" as used herein means an adhesive, such as a pressure sensitive adhesive, or cohesive. Where the connecting bonding material is a cohesive, a similar cohesive material must be placed on the flower pot for bondingly contacting and bondingly engaging with the cohesive material on the base of the carton 10. The term "connecting bonding material" also includes a thickened adhesive such as but not by way of limitation, rubber cement. As shown in FIGS. 1 and 2, the connecting bonding material 81 is disposed on the base 42 of the carton 10 in strips of connecting bonding material, only one of which is designated 81, although the connecting bonding material 81 could also be applied to the base 42 of the carton 10 in the form of spaced-apart spots or in any pattern including covering the entire base 42 of the carton 10 with connecting bonding material 81. The term "spot" or "spots" includes any geometric or non-geometric shape including, but not limited to, what is commonly referred to as strips.

A conventional box may also be used comprising a box insert (not shown) substantially similar to the base 42 of the box 14. The bonding material 81 in that case would be disposed on the upper surface of the box insert rather than on the upper surface of the box base 42.

In a method of operation, a box assembly 12 as described above and a plurality of flower pots 18 containing floral groupings 20 are provided. The flower pots 18 are disposed one at a time in the retaining space 52 of the box assembly 12 so that the lower end base 30 of each flower pot 18 engages at least one strip of connecting bonding material 81 as shown in FIG. 2. Each flower pot 18 is thereby bondingly engaged to the base 42 of the box assembly 12 whereby the flower pots 18 are substantially prevented from moving during movement of the box assembly 12, such as during shipment of the box assembly 12. After the pots 18 containing floral groupings 20 have been disposed in the retaining space 52, the first and second lid flaps 74 and 76 are moved to the closed position. The third and fourth lid flaps 78 and 80 are then each moved to the closed position generally overlaying the first and second lid flaps 74 and 76. The third and fourth lid flaps 78 and 80 may then be secured in this closed position via an adhesive tape or other securing means thereby securing all of the lid flaps 74, 76, 78 and 80 in the closed position covering the pots 18 and floral groupings 20.

Figure 3:
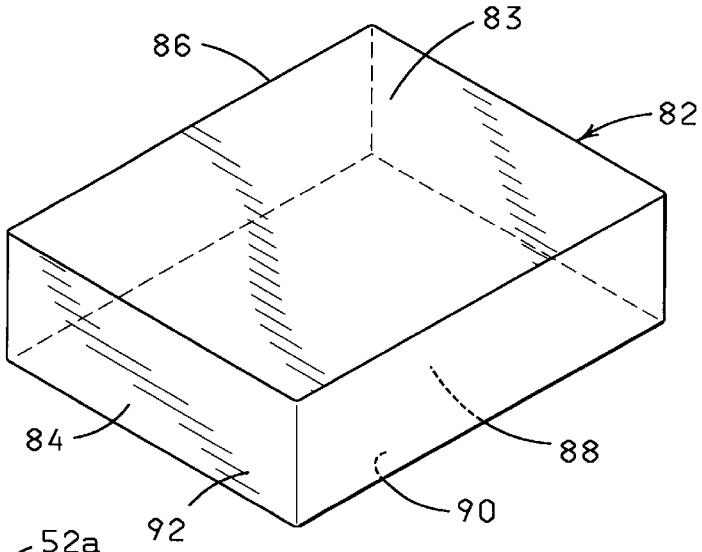
FIG. 3 is a perspective view of a box lid.

The Embodiment and Method of FIGS. 3. 4 and 5

Figure 4:
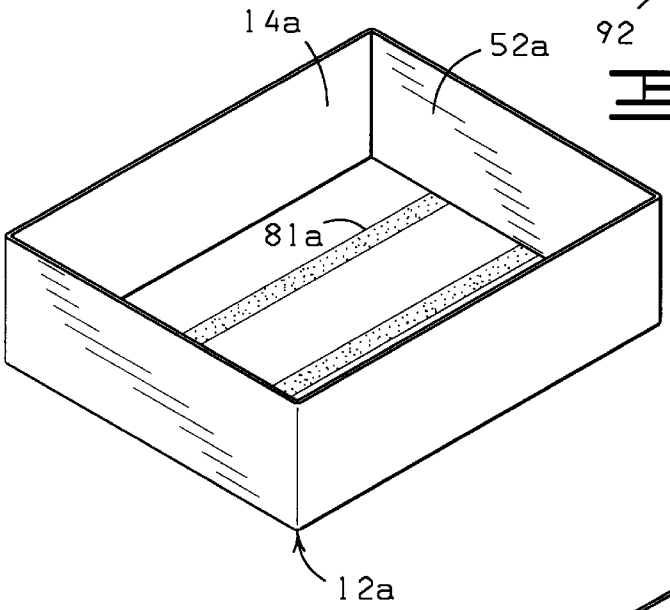
FIG. 4 is a perspective view of a box used with the box lid shown in FIG. 3 in accordance with the present invention.
Figure 5:
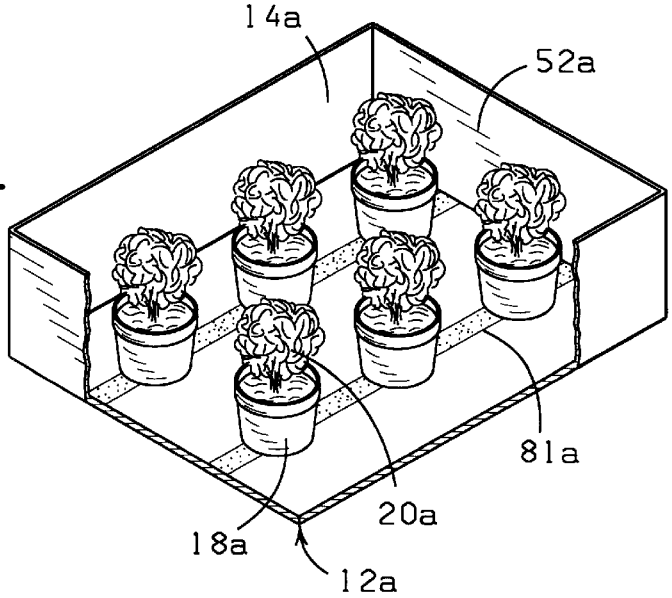
FIG. 5 is a perspective cutaway view of the box assembly shown in FIG. 4 showing flower pots containing floral groupings disposed in the box assembly.

Shown in FIGS. 3, 4 and 5 is a modified box assembly 12. The box assembly includes a box 14 (FIG. 4) which is constructed exactly like the box 14 shown in FIGS. 1 and 2 and described in detail, except that the box assembly 12*a* has no lid flaps 15. The box assembly 12*a* also includes a box lid 82 (FIG. 3). The box lid 82 has a base portion 83 and a plurality of side walls 84. (Only the side wall which is designated by the numeral 84). The plurality of side walls 84 are connected to the base portion 83 and extend generally about the entire outer periphery 86 of the base portion 83. The plurality of side walls 84 each extend generally perpendicularly downward from the base 83 and interconnect to cooperate with the base 83 to form a box receiving space 88. The box lid 82 has an inner surface 90 and an outer surface 92.

In a method of operation (not shown), a box assembly 12*a* as described above and a plurality of flower pots 18*a* containing floral groupings 20*a* are provided. The flower pots 18*a* containing the floral groupings 20*a* are disposed in the retaining space 52*a* of the box 14*a* as shown in FIG. 5. The bonding strips 81*a* each bondingly engage the lower end base 30*a* of each flower pot 18*a* to connect the flower pots 18*a* containing floral groupings 20*a* to the base 42*a* to substantially prevent the movement of the flower pots 18*a* containing the floral groupings 20*a* in the box 14*a* during movements or shipment of the box assembly 12*a*. The box lid 82 is then placed over the open upper end 50*a* of the box 14*a* to a position where the box 14*a* and the box lid 82 cooperate to enclose the retaining space 52*a* of the box 14*a* (not shown).

Figure 6:
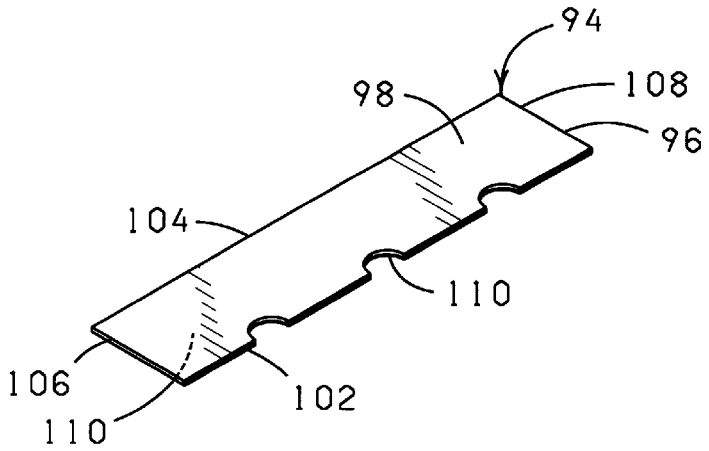
FIG. 6 is a perspective view of a retaining insert constructed in accordance with the present invention.
Figure 7:
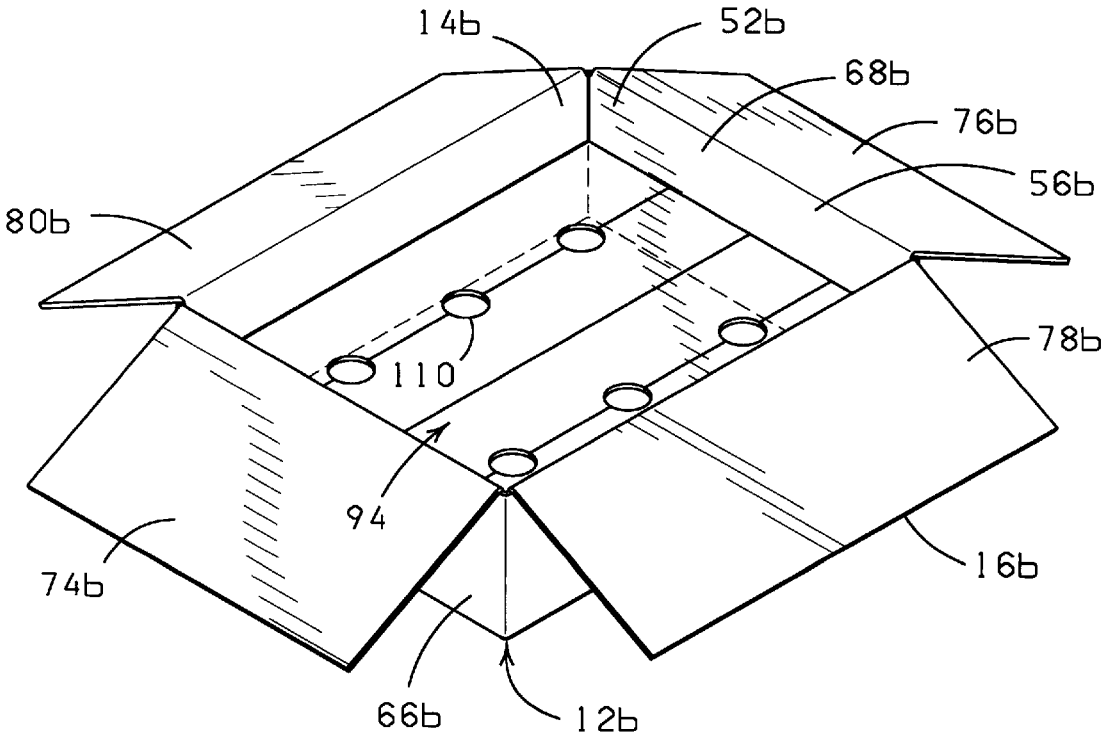
FIG. 7 is a perspective view of the box assembly shown in FIG. 1 with retaining inserts disposed therein.

The Embodiments and Method of FIGS. 6, 7. 8 and 9

Shown in FIG. 6 is a retaining insert 94 which is generally rectangular in shape (although it will be understood that any geometric or non-geometric shape of retaining insert 94 may be used as long as the retaining insert operates in the manner described herein) and has an outer periphery 96, an upper surface 98, a lower surface 100, a first side 102, a second side 104, a first end 106 and a second end 108. A plurality of semi-circular cutouts, only one of which is designated 110, are formed in the first side 102. The plurality of cutouts 110 can be of any geometric or non-geometric shape as long as the plurality of cutouts 110 perform in the manner described herein.

Shown in FIG. 7 is a modified box assembly 12*b*. The box assembly 12*b* is constructed exactly like the box 14 and box lid 15 shown in FIGS. 1 and 2 and described in detail previously.

Figure 8:
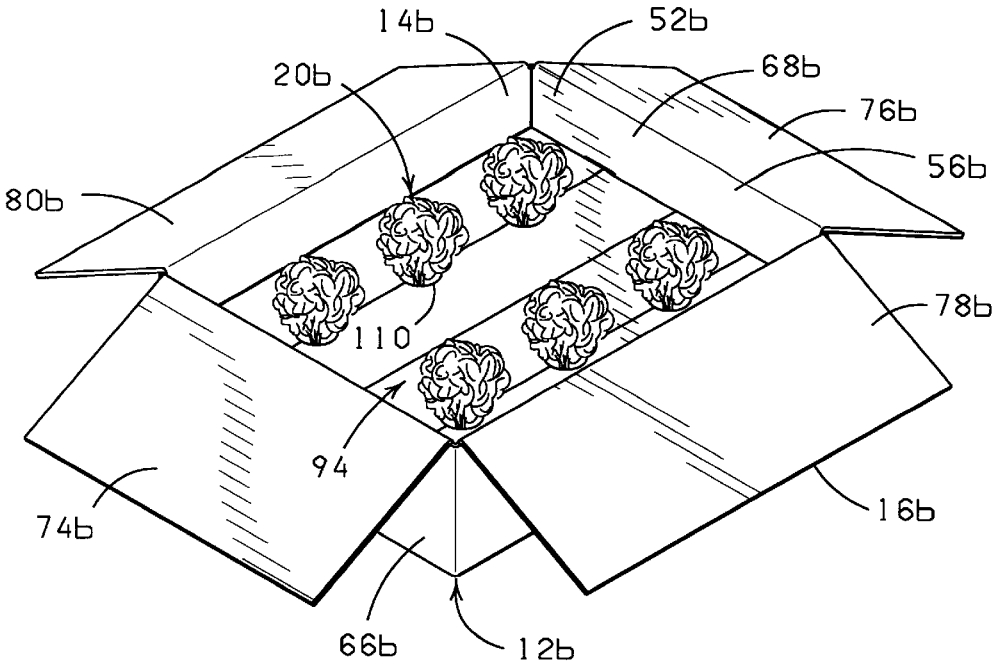
FIG. 8 is a perspective view of a box assembly similar to that in FIG. 1 having retaining inserts, flower pots and floral groupings disposed in the flower pots.
Figure 9:
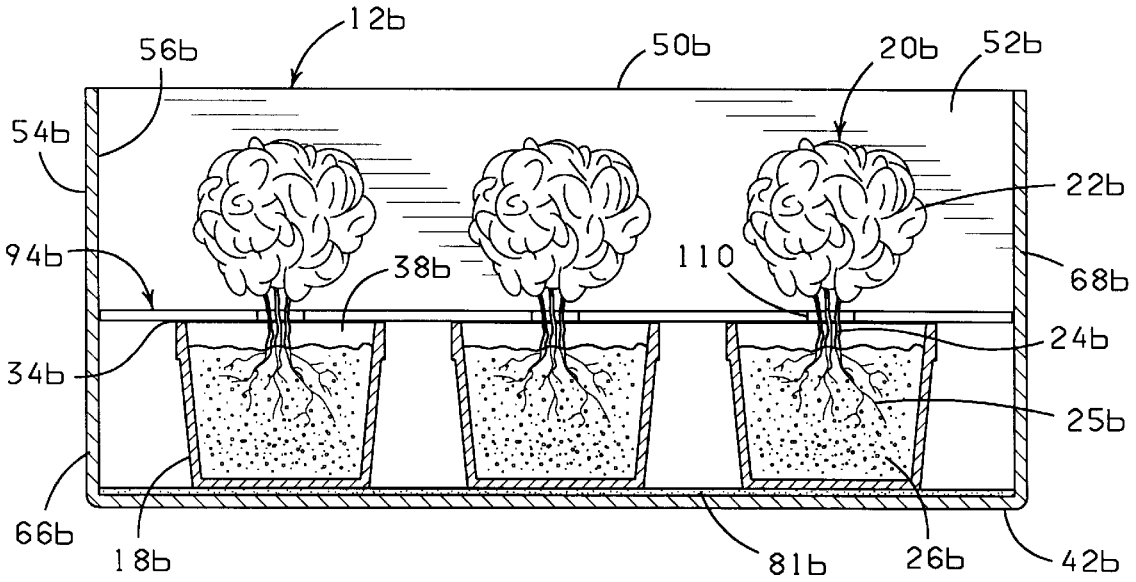
FIG. 9 is a cross section view of a box assembly shown in FIG. 8 showing the retaining inserts and the manner in which they communicate with the flower pots and floral groupings in accordance with the present invention.

The box assembly 12*b* includes a plurality of retaining inserts 94, only one of which is designated as 94, of the type shown in FIG. 6 and described in detail previously. The plurality of retaining cutouts 110 are shaped to encompass a portion of the floral groupings 20*b* as shown in FIGS. 8 and 9. The plurality of retaining inserts 94 extend from the inner surface 56*b* of the first end wall 66*b* of the box 14*b* across the retaining space 52*b* of the box 14*b* to the inner surface 56*b* of the second end wall 68*b* of the box 14*b*. The plurality of retaining inserts 94 are sized whereby the length of each retaining insert 94 is substantially equal to or slightly greater than the distance from the first end wall 66*b* to the second end wall 68*b*, the plurality of retaining inserts 94 thereby capable of being held in place by the friction between the end walls 66*b* and 68*b* and each retaining insert 94 when each retaining insert 94 is disposed in the retaining space 52*b* of the box 14*b*.

The plurality of retaining inserts 94 are disposed in pairs such that each retaining cutout 110 of each retaining insert 94 cooperate with each corresponding retaining cutout 110 of each of the plurality of the retaining inserts 94 to substantially encompass the stem portion 24*b* of the floral grouping 20*b* in one of the flower pots 18*b* (FIG. 9). The plurality of retaining inserts 94 substantially covers the opening 34*b* in the flower pot 20*b* thereby substantially enclosing the growing medium 26*b* (shown in FIG. 2) contained in the retaining space 38*b* of the flower pots 18*b* to retain the growing medium 26*b* and the floral groupings 20*b* in the flower pots 18*b* during movement or shipment of the box assembly 18*b*.

It will be understood that the retaining inserts 94 may be used singly, or more than one retaining insert may be used. Further, the retaining inserts 94 may be used wherein the cutouts 110 encompass at least a portion of each flower pot 18*b*. If more than one retaining insert 94 is utilized, the retaining inserts may encompass both a portion of the flower pot 18*b* and a portion of the stems 24*b* of the floral grouping 20*b*.

In a method of operation, a box assembly 12*b* as described above and a plurality of flower pots 18*b* containing floral groupings 20*b* are provided. The flower pots 18*b* are disposed one at a time in the retaining space 52*b* of the box assembly 12*b* so that the lower end base 30*b* of each flower pot 18*b* bondingly engages at least one strip of connecting bonding material 81*b*. Each flower pot 18*b* is thereby bondingly connected to the base 42*b* of the box assembly 12*b* whereby the flower pots 18*b* are substantially prevented from moving during movement of the box assembly 12*b*, such as during shipment of the box assembly 12*b*. Each of the plurality of retaining inserts 94 is then placed at least partially upon the openings 34*b* of the flower pots 18*b* whereby each retaining insert 94 communicates with the opening 34*b* of each flower pot 18*b* to substantially enclose the growing medium 26*b* within the retaining space 38*b* of the flower pot 18*b*. Alternatively, however, the box assembly 12*b* may not comprise any connecting bonding material 81*b*, only the plurality of retaining inserts 94, as just described, cooperating to both retain each flower pot 18*b* in place and retain the floral group 20*b* and growing medium 26*b* in place, as previously described herein.

After the flower pots 18*b* containing floral groupings 20*b* and the retaining inserts 94*b* have been disposed in the retaining space 52*b*, the first and second lid flaps 74*b* and 76*b* are moved to the closed position. The third and fourth lid flaps 76*b* and 78*b* are then each moved to the closed position generally overlaying the first and second lid flaps 74*b* and 76*b*. The third and fourth lid flaps 78*b* and 80*b* may then be secured in this closed position via an adhesive tape or other securing means thereby securing all of the lid flaps 74*b*, 76*b*, 78*b* and 80*b* in the closed position covering the flower pots 18*b* and floral groupings 20*b* (not shown).

Figure 10:
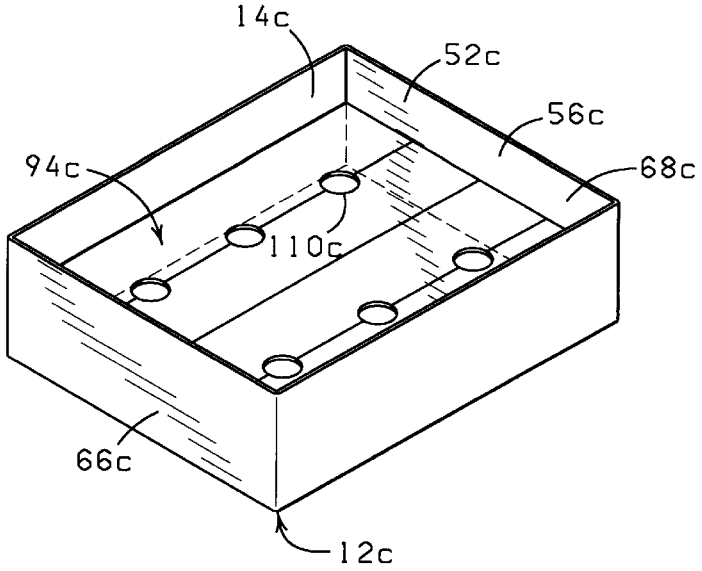
FIG. 10 is a perspective view of the box shown in FIG. 4 with retaining inserts disposed therein.
Figure 11:
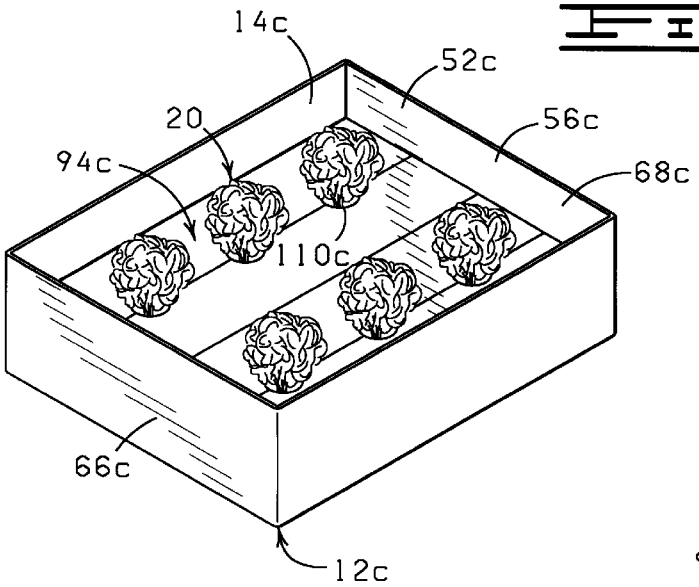
FIG. 11 is a perspective view of a box assembly similar to that in FIG. 10 showing retaining inserts and flower pots containing floral groupings disposed in the box.

The Embodiments of FIGS. 10 and 11

Shown in FIG. 10 is a modified box assembly 12*c*. The box assembly 12*c* includes a box 14*c* and is constructed exactly like the box 14 and box lid 82 shown in FIGS. 3–5 and described in detail previously.

The box assembly 12*c* includes a plurality of retaining inserts 94*c* of the type shown in FIG. 6 and described in detail before. The plurality of retaining cutouts 110*c* are shaped to encompass a portion of the floral groupings 20*c* as shown in FIG. 11. The plurality of retaining inserts 94*c* extend from the inner surface 56*c* of the first end wall 66*c* of the box 14*c* across the retaining space 52*c* of the box 14*c* to the inner surface 56*c* of the second end wall 68*c* of the box 14*c*. The plurality of retaining inserts 94*c* are disposed in pairs such that each of the plurality of the retaining cutouts 110*c* of each of the plurality of retaining inserts 94*c* cooperate with each corresponding retaining cutout 110*c* of each of the plurality of retaining inserts 94*c* to encompass a substantial portion of the floral grouping 20*c* in one of the flower pots 18*c* (FIG. 5) thereby substantially enclosing the growing medium 26*c* (FIG. 5) contained in the flower pots 18*c* to retain the growing medium 26*c* and the floral groupings 20*c* in the flower pots 18*c* during movement or shipment of the box assembly 12*c*.

In a method of operation, a box assembly 12*c* as described above and a plurality of flower pots 18*c* containing floral groupings 20*c* are provided. The flower pots 18*c* are disposed one at a time in the retaining space 52*c* of the box assembly 12*c* so that the lower end base 30*c* of each flower pot 18*c* bondingly engages at least one strip of connecting bonding material 81*c* as shown in FIG. 7. Each flower pot 18*c* is thereby bondingly connected to the base 42*c* of the box 14*c* whereby the flower pots 18*c* are substantially prevented from moving during movement of the box assembly 12*c*, such as during shipment of the box assembly 12*c*. The retaining inserts 94*c* are then placed upon the opening 34*c* of the flower pots 18*c* whereby each retaining insert 94*c* communicates with the opening 34*c* of each flower pot 18*c* to substantially enclose the growing medium 26*c* with the retaining space 38*c* of the flower pot 18*c*.

The box lid 82*c* (not shown) is then placed over the open upper end 50*c* of the box 14*c* to a position where the box 14*c* and the box lid 82*c* cooperate to enclose the retaining space 52*c* of the box 14*c* (not shown).

Figure 12:
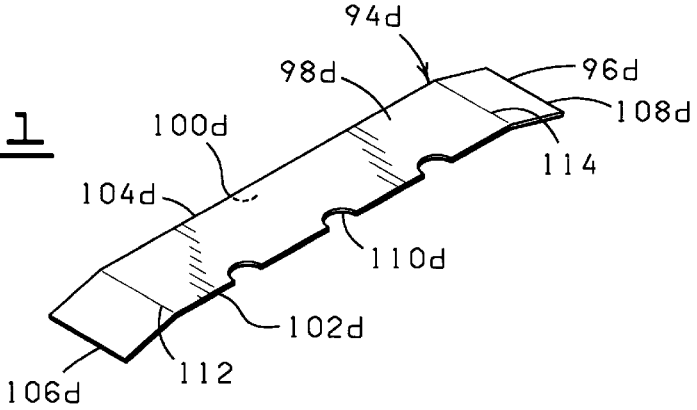
FIG. 12 is a perspective view of a retaining insert having foldable end pieces showing the ends in a partially folded position.
Figure 13:
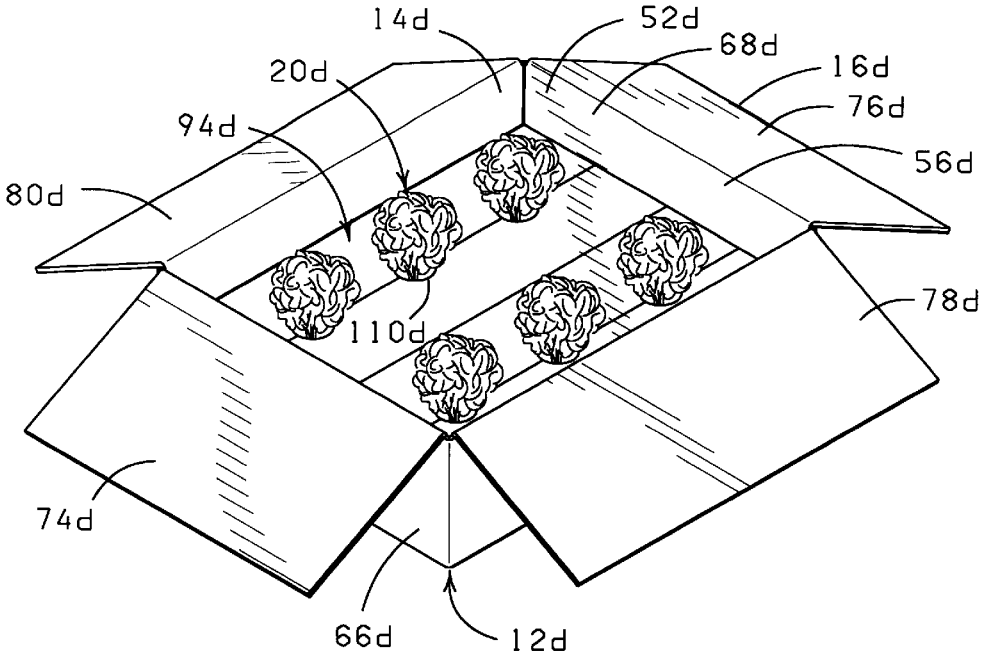
FIG. 13 is a perspective view of the box shown in FIG. 4 with retaining inserts as shown in FIG. 12 disposed therein.
Figure 14:
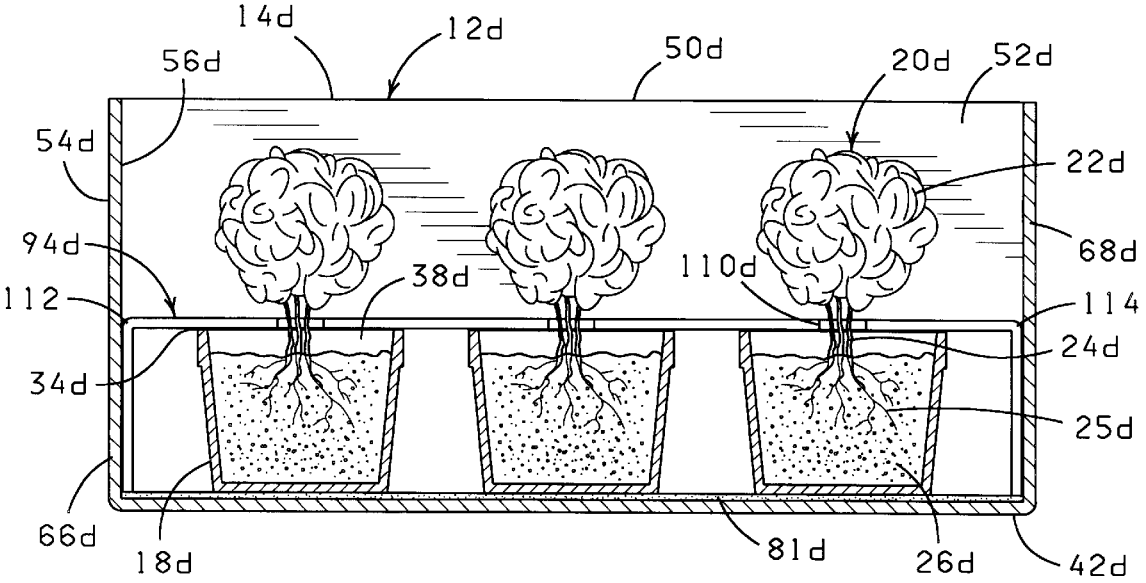
FIG. 14 is a cross section view of the box assembly shown in FIG. 13 showing the retaining inserts with foldable end pieces and the manner in which they communicate with the flower pots and floral groupings in accordance with the present invention.

The Embodiments and Methods of FIGS. 12, 13 and 14

Shown in FIG. 12 is a retaining insert 94*d* which is similar to the retaining insert 94 shown in FIG. 6 except that the retaining insert 94*d* shown in FIG. 12 is greater in length. The retaining insert 94*d* shown in FIG. 12 is generally rectangular in shape (although, as previously described, any shape which functions as described herein may be utilized), and has an outer periphery 96*d*, an upper surface 98*d*, a lower surface 100*d*, a first side 102*d*, a second side 104*d*, a first end 106*d* and a second end 108*d*. A plurality of semi-circular cutouts, only one of which is designated 110*d*, are formed in the first side 102*d*.

A first fold line 112 is located between the first end 106*d* of the retaining insert 94*d* and the cutout 110*d* most proximal to the first end 106*d* of the retaining insert 94*d*. The fold line 112 extends a distance from and is parallel to the first end 106*d* of the retaining insert 94*d*. A second fold line 114 is located between the second end 108*d* of the retaining insert 94*d* and the cutout 110*d* most proximal to the second end 108*d* of the retaining insert 94*d*. The fold line 114 extends a distance from and is parallel to the second end 108*d* of the retaining insert 94*d*. The fold lines 112 and 114 may be a crease, a perforation or any structure which facilitates folding the retaining inserts 94*d* to the proper length.

Shown in FIG. 13 is a modified box assembly 12*d*. The box assembly 12*d* is constructed exactly like the box 14 and box lid 15 shown in FIGS. 1 and 2 and described in detail previously.

The box assembly 12*d* includes a plurality of retaining inserts, only one of which is designated as 94*d*, of the type shown in FIG. 12 and described in detail above. The plurality of retaining cutouts 110*d* are shaped to encompass the stem portion 24*d* of the floral groupings 20*d* as shown in FIGS. 13 and 14. The plurality of retaining inserts 94*d* extend from the inner surface 56*d* of the first end wall 66*d* of the box 14*d* across the retaining space 52*d* of the box 14*d* to the inner surface 56*d* of the second end wall 68*d* of the box 14*d*. When the plurality of retaining inserts 94*d* are folded along the fold lines 112 and 114 whereby the length of each of the plurality of retaining inserts 94*d* as folded is substantially equal to or slightly greater than the distance from the first end wall 66*d* to the second end wall 68*d*, the plurality of retaining inserts 94*b* thereby capable of being held in place by the friction between the end walls 66*d* and 68*d* and each retaining insert 94*d* when the plurality of retaining inserts 94*d* are disposed in the retaining space 52*d* of the box 14*d*. After the plurality of retaining inserts 94*d* are folded, the length of each insert 94*d* between the fold line 112 and the first end 106*d* of each retaining insert 94*d* is substantially equal to the height of the flower pots 18*d*. Likewise, the length of each insert 94*d* between the fold line 114 and the second end 108*d* of each retaining insert 94*d* is substantially equal to the height of the flower pots 18*d*. Additional support and retention of the plurality of retaining inserts 94*d* is thereby provided by the contact of the folded portion of each retaining insert 94*d* with the base 42*d* of the box assembly 12*d*.

The plurality of retaining inserts 94*d* are disposed in pairs such that the plurality of retaining cutouts 110*d* of each of the plurality of retaining inserts 94*d* cooperate with the corresponding plurality of retaining cutout 110*d* of each of the plurality of retaining inserts 94*d* to substantially encompass the stem portion 24*d* of the floral grouping 20*d* in one of the flower pots 18*d* (FIG. 14). The plurality of retaining inserts 94*d* substantially cover the opening 34*d* in the flower pot 18*d* thereby substantially enclosing the growing medium 26*d* (FIG. 14) contained in the retaining space 38*d* of the flower pots 18*d* to retain the growing medium 26*d* and the floral groupings 20*d* in the flower pots 18*d* during movement or shipment of the box assembly 12*d*.

In a method of operation, a box assembly 12*d* as described above and a plurality of flower pots 18*d* containing floral groupings 20*d* are provided. The flower pots 18*d* are disposed one at a time in the retaining space 52*d* of the box assembly 12*d* so that the lower end base 30*d* of each flower pot 18*d* bondingly engages at least one strip of connecting bonding material 81*d* as shown in FIGS. 14. Each flower pot 18*d* is thereby bondingly connected to the base 42*d* of the box assembly 12*d* whereby the flower pots 18*d* are substantially prevented from moving during movement of the box assembly 12*d*, such as during shipment of the box assembly 12*d*. The plurality of retaining inserts 94*d* are folded along the fold lines 112 and 114. The plurality of retaining inserts 94*d* are then placed at least partially upon each opening 34*d* of each flower pot 18*d* whereby the first and second ends 66*d* and 68*d* of each retaining insert 94*d* communicates with the base 42*d* of the box assembly 12*d*, and each retaining insert 94*d* communicates with the opening 34*d* of each flower pot 18*d* to substantially enclose the growing medium 26*d* within the retaining space 38*d* of the flower pot 18*d*.

After the flower pots 18*d* containing floral groupings 20*d* and the retaining inserts 94*d* have been disposed in the retaining space 52*d*, the first and second lid flaps 74*d* and 76*d* are moved to the closed position. The third and fourth lid flaps 78*d* and 80*d* are then each moved to the closed position generally overlaying the first and second lid flaps 74*d* and 76*d*. The third and fourth lid flaps 78*d* and 80*d* may then be secured in this closed position via an adhesive tape or other securing means thereby securing all of the lid flaps 74*d*, 76*d*, 78*d* and 80*d* in the closed position covering the flower pots 18*d* and floral groupings 20*d*.

Figure 15:
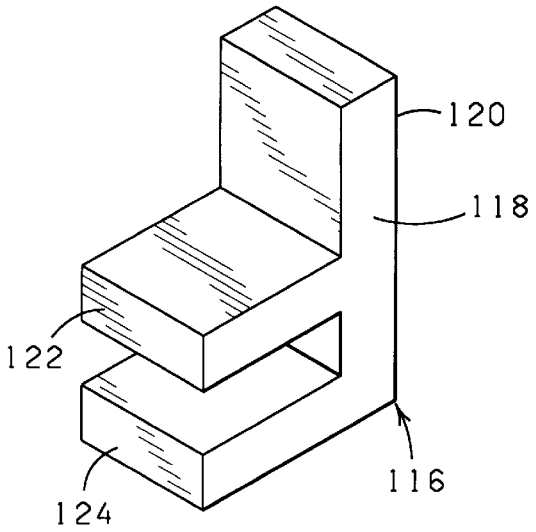
FIG. 15 is a perspective view of a clip which fastens one end of a retaining insert to an inner wall of a box assembly.
Figure 16:
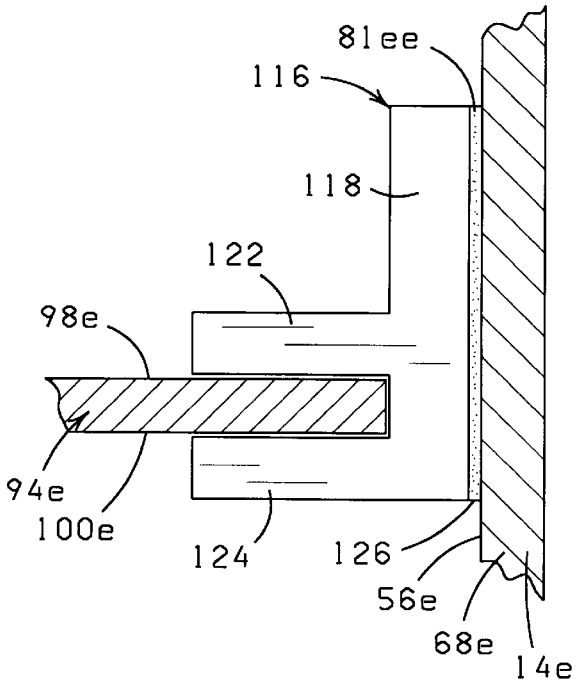
FIG. 16 is a side elevational view of a clip as it cooperates with a retaining insert.
Figure 17:
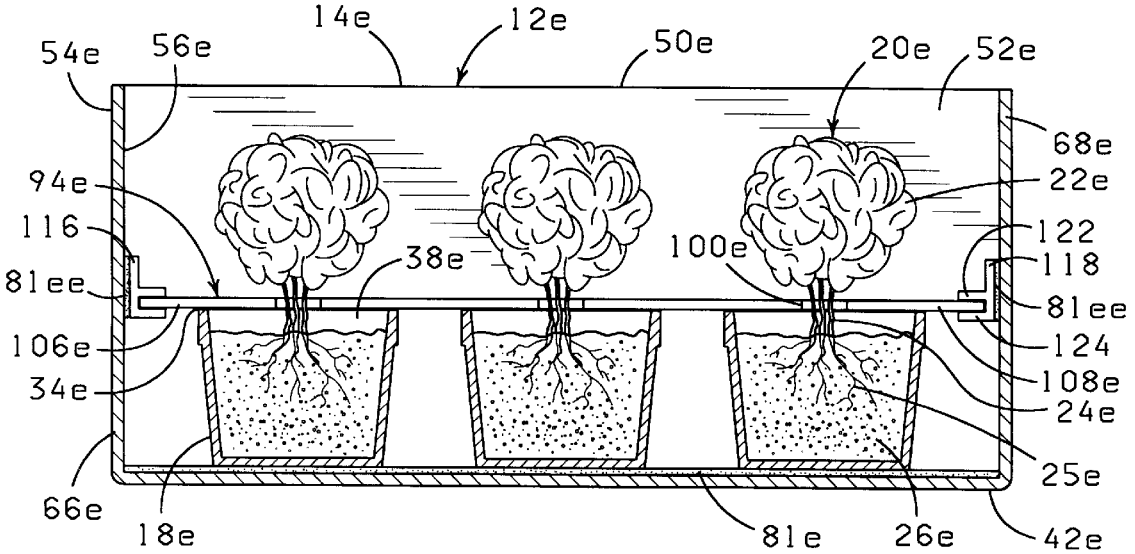
FIG. 17 is a cross section view of a box assembly shown in either FIG. 1 or FIG. 4 showing the retaining inserts and clips and the manner in which they communicate with the flower pots and floral groupings in accordance with the present invention.

The Embodiments of FIGS. 15, 16 and 17

Shown in FIG. 17 is a box assembly 12*e* constructed exactly like the box shown in FIG. 11, but which includes a mechanism in the form of a clip 116 (FIG. 15) for securing the plurality of retaining inserts 94*e* to the inner surface 56*e* of the box assembly 12*e*. The clip 116 cooperates with each retaining insert 94*e* and the inner wall 56*e* of the box assembly 12*e*, as shown in FIGS. 16 and 17.

The plurality of retaining inserts 94*e*, such as those shown in detail in FIG. 6, may be secured to the inner surface 56*e* of the end walls 66*e* and 68*e* of the box assembly 12*e*. FIG. 15 shows one form of clip 116 that may be used for such a purpose, however, any clip or mechanism which operates in the manner described herein may be used. Further, the clip 116 may be secured to the box assembly 12*e* by any method and/or any mechanism known in the art. The clip 116 shown comprises a body 118 with a rear surface 120, an upper member 122 and a lower member 124. The upper member 122 and the lower member 124 of the clip 116 are spaced a distance apart, such distance approximating the thickness of a retaining insert 94*e* (FIG. 16).

FIG. 16 illustrates how the clip 116 operates to secure a retaining insert 94*e* to the inner surface 56*e* of the box assembly 12*e*. A connecting bonding material 81ee is disposed, for example, on the rear surface 120 of the body 118 of the clip 116 so that the body 118 of the clip 116 may be bonded to the inner surface 56*e* of the end walls 66*e* or 68*e* of the box assembly 12*e*. Two clips, only one of which is designated by the numeral 116, are mounted on the inner surface 56*e* of the box 14*e* for each of the plurality of retaining inserts 94*e* disposed in the retaining space 52*e* of the box 14*e* (FIG. 17). Each end 106*e* and 108*e* of each retaining insert 94*e* is disposed between the upper member 122 and the lower member 124 of a clip 116 at a height approximately equal to the height of the upper end 28*e* of the flower pots 18*e* so that the cutouts 110*e* substantially encompass the stem portion 24*e* of the floral groupings 20*e*. The growing medium 26*e* contained in the flower pots 18*e* is thereby substantially enclosed to retain the growing medium 26*e* and the floral groupings 20*e* within the flower pots 18*e* during movement or shipment of the box assembly 12*e*.

In a method of operation, a box assembly 12*e* as described above and a plurality of flower pots 18*e* containing floral groupings 20*e* are provided. The flower pots 18*e* are disposed one at a time in the retaining space 52*e* of the box assembly 12*e* so that the lower end base 30*e* of each flower pot 18*e* bondingly engages at least one strip of connecting bonding material 81*e* (FIG. 17). Each flower pot 18*e* is thereby bondingly connected to the base 42*e* of the box assembly 12*e*.

One clip 116 is bondingly mounted on the first end wall 66*e* of the box 14*e* for each retaining insert 94*e* that is to be disposed in the retaining space 52*e* of the box 14*e*. Likewise, one clip 116 is bondingly mounted on the second end wall 68*e* of the box 14*e* for each retaining insert 94*e* that is to be disposed in the retaining space 52*e* of the box 14*e*. The plurality of retaining inserts 94*e* are then placed upon the opening 34*e* of the flower pots 18*e* whereby each retaining insert 94*e* communicates with the opening 34*e* of each flower pot 18*e* to substantially enclose the growing medium 26*e* with the retaining space 38*e* of the flower pot 18*e*. The first end 106*e* of each retaining insert 94*e* is disposed between the upper member 122 and the lower member 124 of a clip 116 on the inner surface 56*e* of the first side wall 66*e* of the box 14*e*. The second end 108*e* of each retaining insert 94*e* may then be inserted between the upper member 122 and the lower member 124 of the clip 116 located on the inner surface 56*e* of the second side wall 68*e* of the box 14*e*. Alternatively, a clip 116 may be connected to the first end 106*e* of a retaining insert 94*e* and the second end 108*e* of a retaining insert 94*e* before the retaining insert 94*e* is disposed in the retaining space 52*e* of the box 14*e*. After connecting bonding material 81ee has been applied to the rear surface 120 of each clip 116, (or each clip 116 may be supplied with a pre-applied connecting bonding material 8lee), the retaining insert 94*e* with the clips 116 may be disposed in the retaining space 52*e* of the box 14*e* as described above. The clips 116 may then be secured to the first end wall 66*e* and the second end wall 68*e* of the inner surface 56*e* of the box 14*e* by applying pressure to the clips 116 thereby connectably engaging the clips 116 to the box 14*e*.

After the flower pots 18*e* containing floral groupings 20*e* have been disposed in the retaining space 52*e* by any method described herein, the first and second lid flaps 74*e* and 76*e* are moved to the closed position (not shown). The third and fourth lid flaps 78*e* and 80*e* are then each moved to the closed position generally overlaying the first and second lid flaps 74*e* and 76*e*. The third and fourth lid flaps 78*e* and 80*e* may then be secured in this closed position via an adhesive tape or other securing means thereby securing all of the lid flaps 74*e*, 76*e*, 78*e* and 80*e* in the closed position covering the flower pots 18*e* and floral groupings 20*e* (not shown).

Changes may be made in the construction and the operation of the various components, elements and assemblies described herein or in the steps or the sequence of steps of the methods described herein without departing from the spirit and scope of the invention as defined in the following claims.

What is claimed is:

1. A shipping assembly comprising:

a base comprising a support surface and having an adhesive or cohesive bonding material disposed on at least a portion of the support surface of the base; and a floral container having an upper end and a lower end, and having a floral grouping disposed therein, the floral container being disposed upon the support surface of the base and positioned whereby the adhesive or cohesive bonding material on the base engages and bondingly connects the floral container to the base for substantially preventing movement of the floral container on the base during movements of the shipping assembly, the container being removable from the base by disconnecting the floral container from the adhesive or cohesive bonding material.

2. The shipping assembly of claim 1 wherein the adhesive or cohesive bonding material comprises at least one strip of adhesive or cohesive bonding material disposed on the base.

3. The shipping assembly of claim 1 wherein the base of the shipping assembly comprises a first end, a second end, a first side and a second side, and wherein the adhesive or cohesive bonding material comprises at least one strip of bonding material extending between the first and the second sides of the base.

4. A method for shipping floral groupings comprising the steps of:

providing a shipping device comprising a base and having an adhesive or cohesive connecting bonding material disposed thereon;

providing at least one floral container having an upper end and a retaining space and wherein a floral grouping is disposed in the retaining space; and disposing the floral container upon the base whereby the floral container engages the adhesive or cohesive connecting bonding material disposed on the base of the device thereby bondingly connecting the floral container to the base of the shipping device.

5. The method of claim 4 further comprising the step of:

providing a retaining insert having cutouts; and disposing the retaining insert whereby the retaining insert cooperates with the upper end of the floral container and the cutouts of the retaining insert substantially surround a stem portion of the floral grouping thereby substantially enclosing a growing medium within the retaining space of the floral container.

* * * * *